US005481953A

United States Patent [19]

McLeod

[11] Patent Number: 5,481,953

[45] Date of Patent: Jan. 9, 1996

[54] BAGEL HOLDER

[76] Inventor: John A. McLeod, W. Main St., Wilmington, Vt. 05363

[21] Appl. No.: 275,278

[22] Filed: Jul. 15, 1994

[51] Int. Cl.[6] ..... B26D 3/30

[52] U.S. Cl. ..... 83/762; 83/454; 83/932; 269/87.2; 269/295

[58] Field of Search ..... 83/672, 454, 932; 269/87.2, 295; D7/673; 16/225, 226, 255, 277, 280

[56] References Cited

U.S. PATENT DOCUMENTS

| | | | |
|---|---|---|---|
| D. 253,329 | 11/1979 | Latham . | |
| D. 279,156 | 6/1985 | Levine . | |
| D. 316,657 | 5/1991 | Mulherin . | |
| D. 330,315 | 10/1992 | Shved . | |
| D. 343,770 | 2/1994 | McFarling et al. . | |
| 747,175 | 12/1903 | Hill | 16/225 |
| 1,098,941 | 6/1914 | Collins | 83/454 X |
| 1,159,695 | 11/1915 | Marcott | 83/762 |
| 1,725,781 | 8/1929 | Corby | 83/762 X |
| 1,798,551 | 3/1931 | Mocking et al. . | |
| 2,429,756 | 10/1947 | Hartmann . | |
| 2,483,304 | 9/1949 | Vogel | 16/226 X |
| 2,679,274 | 5/1954 | Criner | 83/762 |
| 3,232,333 | 2/1966 | Dixon | 16/225 X |
| 3,347,296 | 10/1967 | Rothman . | |
| 4,399,989 | 8/1983 | Baillie . | |
| 4,412,739 | 11/1983 | Freiberg | 16/225 X |
| 4,454,630 | 6/1984 | Shouldis | 269/87.2 X |
| 4,550,636 | 11/1985 | Josselson et al. . | |
| 4,584,216 | 4/1986 | Kenworthy et al. | 16/225 X |
| 4,747,331 | 5/1988 | Policella . | |
| 4,807,505 | 2/1989 | Campbell et al. | 83/762 X |
| 4,948,106 | 8/1990 | Popeil et al. . | |
| 5,115,704 | 5/1992 | Hyman | 83/762 X |
| 5,228,668 | 7/1993 | Guyer . | |
| 5,287,784 | 2/1994 | Brockett . | |
| 5,361,666 | 11/1994 | Kensrue | 83/454 X |

FOREIGN PATENT DOCUMENTS

| | | | |
|---|---|---|---|
| 2603223 | 3/1988 | France | 83/762 |

*Primary Examiner*—Rinaldi I. Rada

*Attorney, Agent, or Firm*—Richard H. Kosakowski; Holland & Associates

[57] ABSTRACT

An improved bagel holder is disclosed that includes a rigid base and a pair of upstanding vertical sidewalls attached to the base. A first sidewall is attached such that there is no movement of the wall. A second wall is attached to the base by a piece of resilient material such as nylon such that the second wall is movable toward the first wall. A cavity is defined between the inner surface of each of the two walls. The cavity is operable to hold a bagel therewithin. The inner surfaces of the two walls have depressions and protrusions formed thereon to better hold the bagel therewithin. The movable wall has a slot formed therein beginning at the top surface of the wall and extending down a predetermined distance. The slot facilitates the removal of a bagel from the cavity by inserting the tip of a knife through the slot and through the center hole of a bagel and moving the knife upward, thereby also moving the bagel upward and out of the cavity.

28 Claims, 2 Drawing Sheets

BAGEL HOLDER

BACKGROUND OF THE INVENTION

This invention relates to a bagel holder, and more particularly, to a bagel holder that adapts to bagels of varying thicknesses and holds them securely for slicing in half.

Devices for holding a bagel to facilitate the slicing thereof are well known in the art. See, for example, U.S. Pat. Nos. Des. 316,657; 343,770; 330,315; and 279,156. See also (utility-type) U.S. Pat. Nos. 3,347,296; 4,399,989; 4,550,636; 4,747,331; 4,948,106; and 5,228,668. Typically a bagel has a circular outer shape or circumference defining its width, and rounded top and bottom surfaces defining its height or thickness. The bagel also has a circular hole formed through its center and parallel to its height axis, resulting in a toroidal shape for the bagel. Prior to eating the bagel it is normally sliced into two halves by cutting it on a plane through its width dimension.

However, because of the relative hardness of the outer crust of the bagel, the dense mass of the inside of the bagel, and the bagel's relative narrow height, it is difficult to hold a bagel in one hand and safely, accurately and quickly cut the bagel with a knife held in the other hand. This problem has long been recognized and has spawned the development of numerous devices, including those of the aforementioned patents, that attempt to securely hold the bagel while allowing it to be sliced, ideally without injury to the person doing the cutting.

For example, it is known to provide bagel holding devices that comprise two similar halves that are hinged together. The devices open to accommodate the placing of a bagel inside, and then are closed to hold a bagel. Means for guiding the knife may be provided, along with handles to facilitate the opening and closing of the device. See, for example, aforementioned U.S. Pat. Nos. 3,347,296 and 5,228,668. A major drawback of these designs is that they contain moving parts that can wear out and trap food particles, making them relatively expensive and labor intensive to manufacture and assemble, and difficult to clean. Other elaborate hinged designs for bagel holders are disclosed in U.S. Pat. Nos. 4,550,636 and 4,747,331.

The aforementioned U.S. Pat. No. 4,399,989 discloses a bagel slicer having a pair of opposing side plates. A first plate is movable, while the second plate is held rigid. The main drawback with this device is that it is heavy and bulky, it employs a complex mechanism for moving the first plate, and it is not readily portable.

Accordingly, it is a primary object of the present invention to provide a bagel holder that can hold bagels of varying thicknesses in preparation for slicing of the bagels.

It is a general object of the present invention to provide a bagel holder that allows a person to firmly hold the bagel by way of finger pressure applied to a movable side panel of the holder.

It is another object of the present invention to provide a bagel holder with a slot formed in one of the side panels that facilitates the removal of the bagel from within the holder.

It is still another object of the present invention to provide a bagel holder that is relatively simple in structure, as compared to the prior art, yet is aesthetically pleasant due to the choice of materials that comprise the structural components of the holder.

It is yet another object of the present invention to provide a bagel holder that reduces the risk of injury to a person cutting the bagel in half with a knife by not requiring the non-cutting hand to be near the knife.

It is still another object of the present invention to provide a bagel holder that firmly holds a bagel oriented within the holder such that the circular width dimension of the bagel is upright, thereby exposing the height or thickness side of the bagel to a knife for cutting the bagel in a normal manner into two halves using a downward cutting stroke.

It is still another object of the present invention to provide a bagel holder with no intricate fixed or moving parts, thereby making it easy to clean the holder and relatively inexpensive to manufacture.

It is still yet another object of the present invention to provide a bagel holder with wide enough knife guides to allow the knife to cut the bagel into uneven halves if desired, and to allow the knife to cut a bagel that is thinner than usual into approximately equal halves.

The above and other objects and advantages of this invention will become more readily apparent when the following description is read in conjunction with the accompanying drawings.

SUMMARY OF THE INVENTION

To overcome the deficiencies of the prior art, and to achieve the objects listed above, the Applicant has invented an improved device for holding a bagel to facilitate the slicing thereof.

In a preferred embodiment, the bagel holder includes a base made out of a rigid material such as wood. The base is generally of a square or rectangular shape, with a pair of parallel planar surfaces that are also parallel to the surface, such as a kitchen countertop or table, upon which the base normally rests when the holder is in use. The holder also includes a pair of vertical upstanding walls attached to the base. Each wall is also made of a similar rigid material, such as wood. A first wall is fixed, in that it is prevented from any movement with respect to the base, by fixedly securing the wall by screws into a channel formed in the base down from the top surface of the base. The second wall has its lower edge rounded and disposed slightly above the top surface of the base. A thin, rectangular-shaped piece of resilient material, such as nylon, is embedded part way both into the base down from a top surface thereof and into the second wall up from the lower edge thereof. The nylon renders the second wall movable with respect to the first wall. The two walls are arranged in parallel such that the inner surfaces of the walls are in parallel and face each other. The spacing between the inner surfaces of the two walls approximates the largest anticipated height or thickness of any commercially available bagel. The spacing forms a cavity into which a bagel is inserted "sideways" with its width dimension oriented vertically. The vertical side ends of each wall form a guide slot for a knife used to cut the bagel. The inner surfaces of the two walls have slotted depressions formed therein that terminate in a semi-circular shape at their lowest portion. The inner surfaces also have one or more rib protrusions emanating therefrom. The movable wall has a thin slot formed therethrough beginning at the top surface of the wall and extending downward a selected distance.

In use, a bagel is inserted into the cavity between the walls; more specifically, into the cavity and within the depressions and against the protrusions formed on the inner surfaces of the walls. A person then applies finger pressure, if needed, with one hand to the movable wall. This moves the movable wall closer to the fixed wall, putting a greater holding pressure on the bagel. The person then cuts the bagel in half with a knife held in the other hand. After the bagel is cut, the tip of the knife is inserted into the slot in the movable wall and into the hole in the center of the bagel. The knife is moved upwardly, moving the bagel upwardly as well to a point where the bagel can be easily grasped by hand and removed entirely out of the holder.

DETAILED DESCRIPTION OF THE PREFERRED EMBODIMENT

Figure 1:
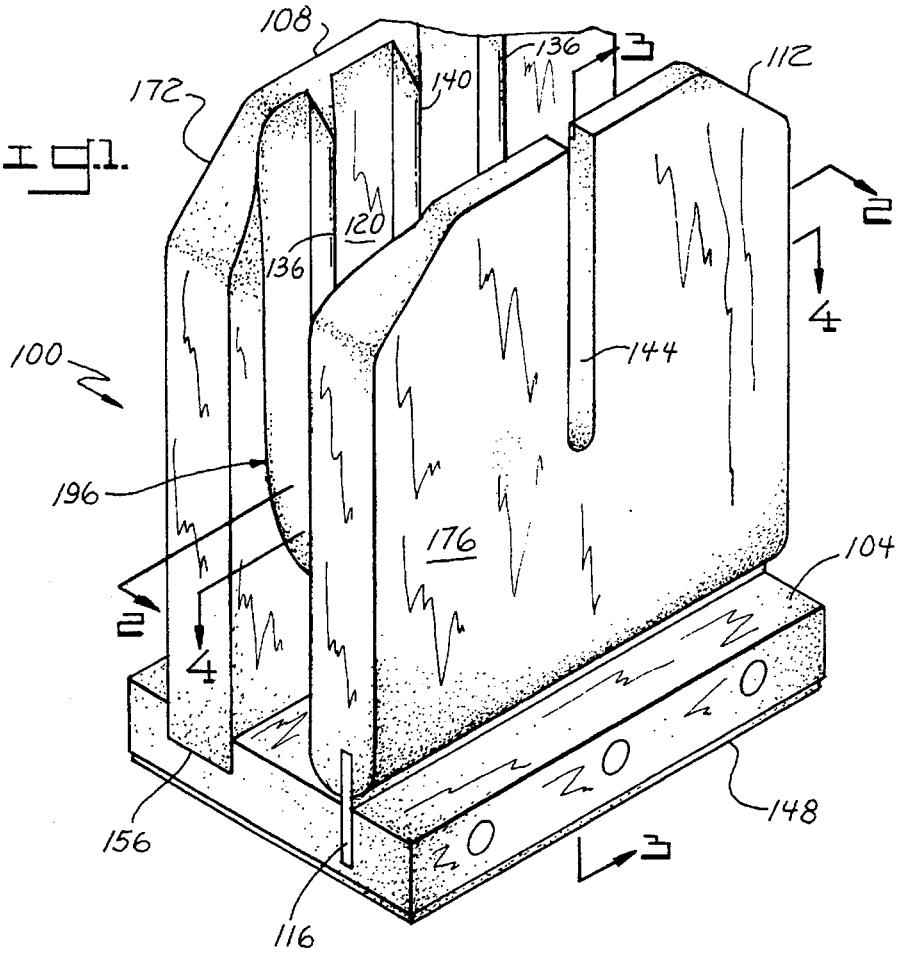
FIG. 1 is a perspective view of a bagel holder according to the present invention.

Referring to the drawings in detail, a preferred embodiment of a bagel holder of the present invention is illustrated therein and generally designated by the reference numeral 100. The holder 100 includes a base 104 that rests on a surface (not shown) such as a countertop or a table. The holder 100 also includes a pair of upstanding, rigid sidewalls 108, 112. A first sidewall 108 is fixedly attached to the base 104 such that there is no movement of the wall 108. The second sidewall 112 is attached to the base 104 by a piece of resilient material 116, allowing relative movement of the second wall 112 with respect to the first wall 108. An inner surface 120, 124 of each wall 108, 112 has a depression 128, 132 formed therein. The bottom portion of each depression 128, 132 is of a semicircle shape. Also, the inner surface 128, 124 of each wall 108, 112 has one or more "rib" protrusions 136, 140 formed thereon. The movable wall 112 has a slot 144 formed therethrough beginning at the top surface of the wall 112 and extending down to the approximate center of the wall 112.

Referring now to FIG. 1, there illustrated in perspective is the bagel holder 100 of the present invention. The holder 100 includes the base 104, which generally comprises a square or rectangular-shaped piece of rigid material. In a preferred embodiment, the base 104 comprises wood; more specifically, a yellow birch. Attached to the bottom of the base 104 is a thin piece of a non-skid material 148, such as, for example, a closed-cell neoprene. The non-skid material 148 enables the holder 100 to better frictionally engage a surface, such as a countertop or tabletop, upon which the holder 100 normally rests when used to slice a bagel 152. The non-skid material 148 is typically attached to the bottom surface of the base 104 by an adhesive.

Figure 3:
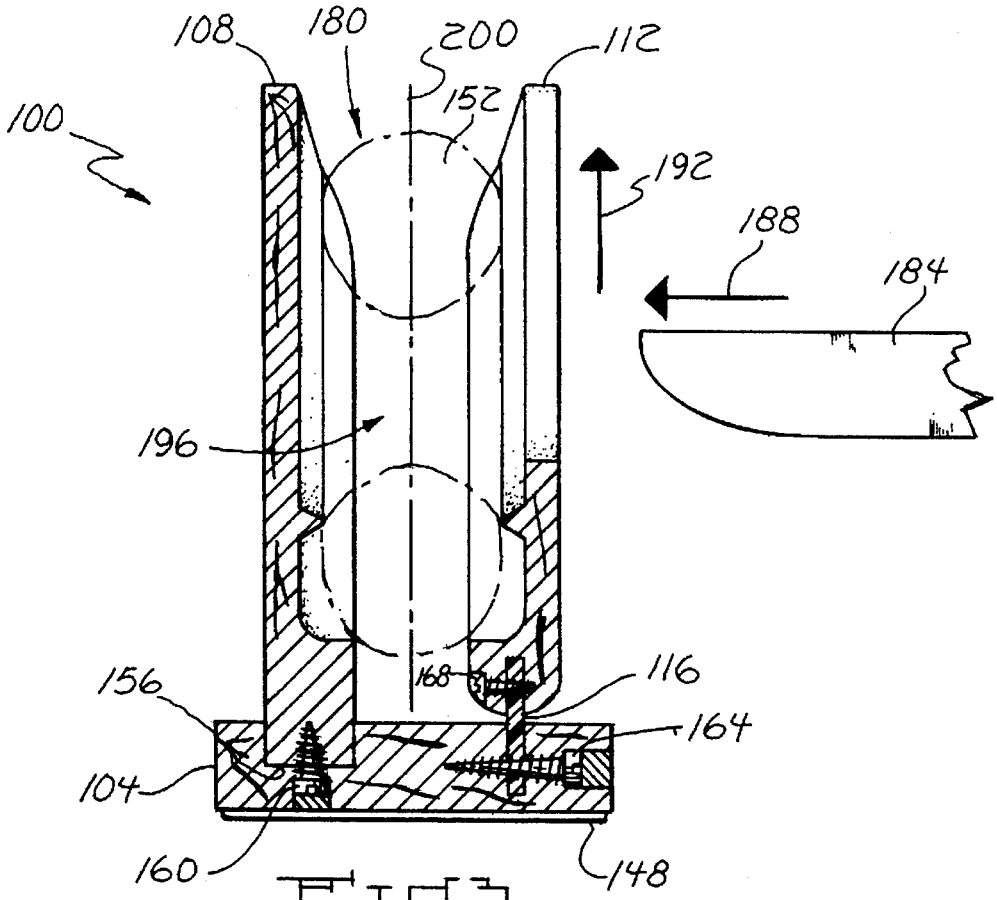
FIG. 3 is a sectional view taken along the lines 3—3 of FIG. 1 of the bagel holder of FIG. 1 having a bagel disposed in a cavity therein, and also illustrating a portion of a knife operable to remove the bagel from the holder.

The holder 100 also includes a pair of vertically-oriented, upstanding sidewalls 108, 112. The sidewalls 108, 112, in a similar manner to the base 104, are made of a rigid material such as wood; and in a preferred embodiment, yellow birch. A first sidewall 108 is fixed with respect to the base 104 and to the second sidewall 112 such that there is no relative movement with respect thereto. The fixed wall 108 fits within a depression or slotted channel 156 formed in the base 104 down through a top surface thereof. As best seen in FIG. 3, the fixed wall 108 is secured to the base 104 by means of one or more screws 160 that enter from the bottom of the base 104 and are countersunk into the bottom surface of the base 104. The screws 160 are attached prior to application of the non-skid material 148 to the bottom surface of the base 104. In the alternative, the wall 108 may be secured to the base 104 by an adhesive.

The second wall 112 is attached to the base 104 by a piece of resilient material 116 such as, for example, nylon or spring steel. In a preferred embodiment, the resilient material 116 comprises a nylon of the commercially available type known as "six oblique six". However, it should be understood that this type of material is purely exemplary; any thermoplastic or metal material (such as spring steel) with a high fatigue resistance (i.e., a "membrane with memory") may be utilized in light of the broadest scope of the present invention. As can be seen in the figures, the nylon membrane 116 is rectangular in shape, approximately 0.093" thick, and spans the entire length of both the base 104 and the wall 112. Approximately half of the nylon membrane 116 is embedded into the base 104, while the other half of the nylon membrane 116 is embedded into the movable wall 112. The nylon membrane 116 is inserted into a slot formed in the base 104 down from a top surface thereof. As best seen in FIG. 3, one or more screws 164 fixedly attach the nylon membrane 116 within the base 104. These screws 164 enter the base 104 from a side thereof and are countersunk. The countersink holes are filled with, e.g., a wooden dowel.

The nylon membrane 116 also attaches to the movable wall 112 by insertion of the membrane 116 in a corresponding slot formed in the wall 112 up from a bottom rounded surface of the wall. The bottom-most point of the rounded surface of the movable wall 112 is spaced a small amount from the top surface of the base 104. One or more screws 168 fixedly attach the nylon membrane 116 to the wall 112. The screws 168 enter the material comprising the movable wall 112 from an inner surface 124 thereof. This is a preferred method of attaching the screws 168 to both the nylon membrane 116 and the movable wall 112 in that when the movable wall 112 is flexed inwardly in a direction toward the fixed wall 108, the resulting stress forces are pushing against the body of the screws 168. If the screws 168 were inserted into the wall 112 from the outer surface of the wall 112, then the inward movement of the wall 112 would tend to generate a pulling force that would allow the screws 168, over time, to be pulled out of the wall 112. This would compromise the integrity of the connection of the nylon membrane 116 to the movable wall 112.

Figure 2:
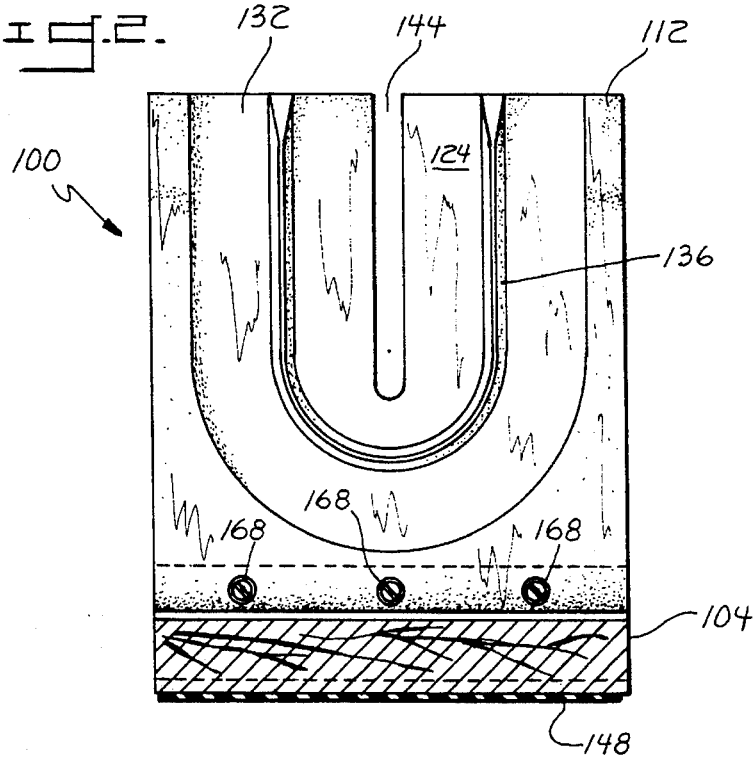
FIG. 2 is a sectional view taken along the lines 2—2 of FIG. 1 of a portion of the bagel holder of FIG. 1.
Figure 4:
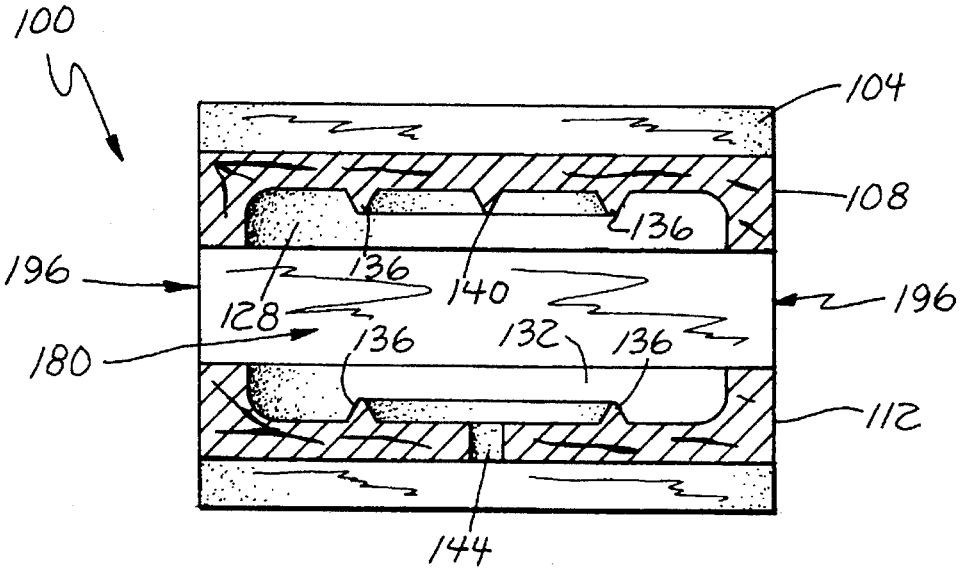
FIG. 4 is a sectional view taken along the lines 4—4 of FIG. 1 of a portion of the bagel holder of FIG. 1.

Both the fixed wall 108 and the movable wall 112 have outer surfaces 172, 176 that are generally planar throughout. In contrast, each wall 108, 112 has an inner surface 120, 124 that has a portion of the wall material removed in the shape of a depression 128, 132. As best seen in FIG. 2, each depression 128, 132 has a "U" shape, with a lower portion in the form of a semicircle. The depression 128, 132 formed on each inner surface 120, 124 forms a guide slot for a normally round bagel 152, illustrated in phantom in FIG. 3. Taken together, the parallel-oriented two upstanding sidewalls 108, 112 with their corresponding depressions 128, 132 form a cavity 180 therebetween into which the bagel 152 is inserted for slicing. Each inner surface 120, 124 also has one or more protrusions 136, 140 in the form of "ribs" that emanate out into the cavity 180. The inner surfaces 120, 124 of both walls 108, 112 have a first protrusion 136 in the shape of a "U". The fixed wall 108 has a second protrusion 140 formed thereon, in the shape of a vertical "rib" extending down from a top surface of the wall 108, as best seen in FIGS. 1 and 4. These protrusions 136, 140 function to contact the bagel 152 disposed in the cavity 180 between the two walls 108, 112 and better hold it in place.

Another structural feature of the bagel holder 100 of the present invention is a slot 144 formed clear through the material comprising the movable sidewall 112. The slot 144 begins at a top surface of the movable sidewall 112 and proceeds vertically downward to approximately the center of the wall 112, as best seen in FIG. 1. In a preferred embodiment of the present invention, the slot 144 is approximately three-eighths of an inch wide. For safety reasons, this dimension was chosen so that normally one could not insert a finger into the slot 144 and possible be injured by a knife cutting the bagel 152. The slot 144 facilitates the placing of an implement, such as a knife 184, therethrough and into the center circular hole of the bagel inserted in the cavity 180. After the bagel 152 is cut by a knife 184, the user inserts the knife 184 into the slot 144 and into the hole in the center of the bagel, as illustrated by the arrowhead 188 in FIG. 3. The user then moves the knife 184 upward, as illustrated by the second arrowhead 192 in FIG. 3. The knife 184 is moved upward within the slot 144, and such upward movement moves the bagel 152 upward and out of the cavity 180 until it reaches a point where it can be grasped by the hand and removed entirely from the bagel holder 100.

In use, the bagel holder 100 is placed on a level surface, such as a tabletop or a countertop. The generally toroidal-shaped bagel 152 is then inserted within the cavity 180 defined by the inner surfaces 120, 124 of the two walls 108, 112. The depressions 128, 132 and rib protrusions 136, 140 formed on the inner surfaces 120, 124 of the two walls 108, 112 guide the bagel 152 in place. The bagel 152 is normally inserted down to the bottom of the depressions 128, 132 at the semicircular portions thereof, as illustrated in FIG. 3. Depending upon the thickness of the bagel 152, the user may then be required to grasp the movable wall 112 and apply finger pressure thereto in a direction that moves the movable sidewall 112 inward toward the fixed wall 108. This applies further pressure to the bagel 152 in the cavity 180 to better hold the bagel 152 during slicing thereof. This finger pressure can be accomplished with one hand of the user, and the nature of the bagel holder 100 of the present invention is such that either a left-handed or right-handed person may use the holder 100. Assuming the person grasps the movable wall 112, and, perhaps also the fixed wall 108 with only his/her left hand, the user holds the knife 184 in his/her right hand. Both the thickness of each wall 108, 112 and the distance separating them are such that guide slots 196 for the knife 184 result. The user proceeds to cut the bagel 152 into two approximate halves, or in other proportions, if desired, by using a downward cutting stroke along the axis 200 indicated in FIG. 3. The design of the bagel holder 100 is such that, if the other hand is employed to put pressure on the movable wall 112 to move it inward toward the fixed wall 108 to better hold the bagel 152, that hand is out of harms way with respect to the knife 184 cutting the bagel 152.

Once the bagel 152 has been sliced into two pieces, the user then proceeds to insert the tip of the knife 184 through the slot 144 in the movable wall 112. The user then brings the knife 184 upward, bringing the bagel 152 upward as well until it can be removed entirely from the bagel holder 100 by grasping the bagel 152 with the hand.

In accordance with the present invention, the distance separating the inner surface 120, 124 of each wall 108, 112 is chosen to accommodate a commercially-available bagel 152 having a known thickness that is approximately the largest known thickness. However, it is known to provide commercially-available bagels 152 in the market place that have smaller thicknesses. The bagel holder 100 of the present invention can accommodate these thinner bagels 152 by allowing the user to apply pressure to the movable wall 112 to move it inward toward the fixed wall 108. This movement adds sufficient pressure to the bagel 152 to properly hold it in place for slicing. The nature of the resilient material 116, such as nylon, is such that it returns to its normal, at-rest position once the finger pressure has been removed from the wall 112 (i.e., it has "memory"). If desired, the movable wall 112 can also be moved in an opposite direction away from the fixed wall 108 to accommodate unusually-thick bagels 152.

A further feature of the present invention is that resulting guide slots 196 formed between the two walls 108, 112 for guiding the knife 184 are wide enough such that the user can cut the bagel 152, if desired, into something other than two equally-thick halves. That is, the spacing between the sidewalls 108, 112 allows some lateral movement of the knife 184. The knife 184 can also be directed, if desired, at an angle with respect to the vertical axis 200 of FIG. 3.

The present invention has been described as comprising a base 104 and two upstanding sidewalls 108, 112 made of a rigid material, such as wood. Wood was chosen in the preferred embodiment in part because of its aesthetic appearance. That is, it is hoped that the bagel holder 100 of the present invention is pleasingly decorative such that the user wishes to have the bagel holder 100 remain on a countertop or at some other location within the kitchen and have it blend with the decor. However, it is to be understood that other materials, either rigid or flexible, may be utilized within the broadest scope of the invention.

Further, the present invention has been described as having two upstanding sidewalls 108, 112 in which one wall 108 is fixed so that no relative movement of the wall 108 with respect to the other wall 112 is allowed. Also, the second wall 112 is movable with respect to the first wall 108. It is to be understood however that both walls 108, 112, if desired, could be mounted to be movable with respect to each other, in light of the teachings herein. For example, both walls 108, 112 could be mounted to the base 104 using a resilient material such as nylon. In the alternative, the base 104 may comprise a resilient material such as a nylon, and both upstanding sidewalls 108, 112 could be rigidly mounted to the base 104. In this instance, finger pressure to either or both walls 108, 112 would cause the base 104 to flex, thereby allowing relative movement of the walls 108, 112 with respect to eachother. However, a problem with this design is that the user would tend to repeatedly cut into the base material, thereby compromising its integrity and reducing the anticipated lifetime of the bagel holder 100.

Still further, it should be understood that the shape of the depressions 128, 132 formed on the inner surfaces 120, 124 of both walls 108, 112, along with the shape of the protrusions 136, 140 formed thereon are purely exemplary. Other shapes may be utilized. It suffices for the present invention that a depression 128, 132 be formed in each sidewall 108, 112 such that it aides in guiding a bagel 152 into proper position, and also holds it there for proper slicing of the bagel 152.

Also, the slot 144 formed in the movable sidewall 112 as described herein is purely exemplary. The slot 144 need not be formed as described and illustrated herein. Instead, for example, the slot 144 may only be formed at the approximate center of the wall such that a knife 184 inserted therethrough engages the bagel 152 at its center thereof. It suffices that the slot 144 have some dimension to allow the knife 184 relative movement therewithin so as to be able to move the bagel 152 somewhat in an upward or even sideward direction to allow the bagel 152 to be at least partially removed from the cavity 180 between the walls 108, 112 so that it can be gripped by the hand of a user and removed entirely from the holder 100. Further, the slot 144 could be formed in either wall, or a slot could be formed in both sidewalls 108, 112.

It should be understood by those skilled in the art that obvious structural modifications can be made without departing from the spirit of the invention. Accordingly, reference should be made primarily to the accompanying claims, rather than the foregoing specification, to determine the scope of the invention.

Having thus described the invention, what is claimed is:

1. In a food article holding device having a base operable to rest on a surface together with a first upstanding wall attached to the base and a second upstanding wall attached to the base, a cavity being defined between inner surfaces of the first and second walls, the walls comprising means for holding the food article in the cavity, wherein the improvement comprises means for resiliently attaching the second wall to the base wherein the second wall can move relative to the first wall while a bottom portion of the second wall remains attached to the base, wherein the means for resiliently attaching comprises a planar piece of resilient material attached to both the base and the second wall.

2. The device of claim 1, further comprising means, attached to a bottom surface of the base, for preventing relative movement between the device and the surface upon which the base rests.

3. The device of claim 2, wherein the means for preventing comprises at least one piece of non-skid material attached to the bottom surface of the base.

4. The device of claim 3, wherein the non-skid material is a closed-cell neoprene.

5. The device of claim 1, wherein the base comprises a rigid, non-flexible material.

6. The device of claim 5, wherein the base material is wood.

7. The device of claim 1, wherein the first wall is attached to the base by one or more screws.

8. The device of claim 1, wherein the base has a slotted depression formed therein down from a top surface of the base, a bottom portion of the first wall is inserted into the slotted depression.

9. The device of claim 8, wherein the first wall is attached to the base by one or more screws.

10. The device of claim 1, wherein the resilient material comprises a nylon-based material.

11. The device of claim 1, wherein the resilient material comprises a steel-based material.

12. The device of claim 1, wherein at least one of the first and second walls has a slot formed therein, the slot beginning at a top surface of the wall and extending generally vertically downward a predetermined distance to intersect a center of the wall, the slot being operable to accommodate an implement to be inserted in the slot and also in a portion of a food article, the implement being moved in an upward direction within the slot to also cause upward movement of the food article in a direction out of the cavity.

13. The device of claim 1, wherein an inner surface of each of the first and second walls face each other, and wherein the inner surfaces have depressions formed therein to aid in confining a food article within the cavity defined by the first and second walls.

14. The device of claim 1, wherein an inner surface of each of the first and second walls has one or more protrusions formed thereon, the protrusions being directed inward towards the center of the cavity defined by the first and second walls.

15. The device of claim 1, wherein the resilient material is affixed to the second wall by one or more fasteners, wherein a majority of the body of each fastener is located between the resilient material and the inner surface of the second wall such that when the second wall is moved relative toward the first wall a force is exerted on the fastener that tends to prevent any loosening of the fastener.

16. The device of claim 15, wherein the fasteners are screws.

17. The device of claim 1, wherein the first and second walls both comprise a rigid material.

18. The device of claim 17, wherein the rigid material is wood.

19. The device of claim 1, wherein a first portion of the planar piece of resilient material is inserted in a slotted depression formed in the base down from a top surface of the base, and wherein a second portion of the planar piece of resilient material is inserted in a slotted depression formed in the second wall up from a bottom surface of the second wall.

20. A device for holding a bagel so that it can be sliced, the device comprising:

a. a base;

b. a first upstanding wall attached to the base at a top surface of the base; and c. a second upstanding wall attached to the base by a planar piece of resilient material, a cavity being defined between inner surfaces of the first and second walls, the cavity being operable to hold the bagel therewithin, wherein the inner surface of at least one of the first and second walls has a depression formed therein, a lower portion of the depression having a semi-circular shape.

21. A device for holding a bagel so that it can be sliced, the device comprising:

a. a base;

b. a first upstanding wall attached to the base at a top surface of the base; and c. a second upstanding wall attached to the base by a planar piece of resilient material, a cavity being defined between inner surfaces of the first and second walls, the cavity being operable to hold the bagel therewithin, wherein the inner surface of at least one of the first and second walls has one or more protrusions formed therein, at least one of the protrusions extending vertically along the inner surface.

22. The device of claim 21, wherein another one of the protrusions has a lower portion with a semi-circular shape.

23. A device for holding a bagel so that it can be sliced, the device comprising:

a. a base;

b. a first upstanding wall attached to the base; and c. a second upstanding wall attached to the base, a cavity being defined between inner surfaces of the first and second walls, the cavity being operable to hold the bagel therewithin, wherein the second wall is attached to the base by a planar piece of resilient material, a first portion of the planar piece of resilient material being mounted within a slotted depression formed in the base down from a top surface of the base, a second portion of the planar piece of resilient material being mounted within a slotted depression formed in the second wall up from a bottom surface of the second wall, wherein the inner surface of each one of the first and second walls has a depression formed therein, a lower portion of each one of the depressions having a semi-circular shape, each one of the depressions having one or more protrusions formed on the inner surface of the wall within the depression, at least one of the protrusions having a first portion that extends vertically and a second portion with a semi-circular shape, another one of the protrusions extending generally vertically, a lower portion of the second wall having a semi-circular shape.

24. A device for holding a bagel so that it can be sliced, the device comprising:

a. a base;

b. a first upstanding wall attached to the base; and c. a second upstanding wall attached to the base, a cavity being defined between inner surfaces of the first and second walls, the cavity being operable to hold the bagel therewithin, wherein the second wall is attached to the base by a planar piece of resilient material, a first portion of the planar piece of resilient material being mounted within a slotted depression formed in the base down from a top surface of the base, a second portion of the planar piece of resilient material being mounted within a slotted depression formed in the second wall up from a bottom surface of the second wall, wherein the inner surface of each one of the first and second walls has a plurality of depressions formed therein, the depressions extending vertically from a top of the wall down to a bottom of the wall, a lower portion of the second wall being curved on at least that portion of the lower portion the second wall that faces the cavity.

25. A food article holding device, comprising:

a. a base;

b. a first upstanding wall attached to the base; and c. a second upstanding wall fixedly attached to the base by a single piece of resilient material having a top end portion and a bottom end portion, the top end portion being fixedly attached to the second wall, the bottom end portion being fixedly attached to the base, a cavity being defined between inner surfaces of the first and second walls, the walls comprising means for holding the food article in the cavity.

26. The device of claim 25, wherein the top end portion of the single piece of resilient material is fixedly attached to the second wall by being embedded in a slotted depression formed in the second wall up from a bottom surface of the second wall.

27. The device of claim 25, wherein the bottom end portion of the single piece of resilient material is fixedly attached to the base by being embedded in a slotted depression formed in the base down from a top surface of the base.

28. The device of claim 25, wherein the single piece of resilient material has a surface at least a portion of which is planar.

* * * * *